US006396369B1

(12) United States Patent
Schlitz et al.

(10) Patent No.: US 6,396,369 B1
(45) **Date of Patent: *May 28, 2002**

(54) ROTARY CONTACT ASSEMBLY FOR HIGH AMPERE-RATED CIRCUIT BREAKERS

(75) Inventors: Dan Schlitz, Burlington; Gary Douville, East Hartford; Thomas O'Keeffe, Farmington; Stephen Wuest, Bristol, all of CT (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/384,908

(22) Filed: Aug. 27, 1999

(51) Int. Cl.[7] ..... H01H 73/00

(52) U.S. Cl. ..... 335/16; 335/147; 335/195; 218/22

(58) Field of Search ..... 355/16, 147, 195; 218/22

(56) References Cited

U.S. PATENT DOCUMENTS

| | | | |
|---|---|---|---|
| 2,340,682 | A | 2/1944 | Powell |
| 2,719,203 | A | 9/1955 | Gelzheiser et al. |
| 2,937,254 | A | 5/1960 | Ericson |
| 3,158,717 | A | 11/1964 | Jencks et al. |
| 3,162,739 | A | 12/1964 | Klein et al. |
| 3,197,582 | A | 7/1965 | Norden |
| 3,307,002 | A | 2/1967 | Cooper |
| 3,517,356 | A | 6/1970 | Hanafusa |
| 3,631,369 | A | 12/1971 | Menocal |
| 3,803,455 | A | 4/1974 | Willard |
| 3,883,781 | A | 5/1975 | Cotton |
| 4,129,762 | A | 12/1978 | Bruchet |

(List continued on next page.)

FOREIGN PATENT DOCUMENTS

| | | |
|---|---|---|
| BE | 819 008 A | 12/1974 |
| DE | 10 52 531 B | 3/1959 |
| DE | 12 27 978 | 11/1966 |
| DE | 30 47 360 | 8/1982 |

*Primary Examiner*—Lincoln Donovan
(74) *Attorney, Agent, or Firm*—Cantor Colburn LLP

(57) ABSTRACT

A circuit breaker rotary contact assembly employs a rotor assembly to operate the moveable contact arms. Separate pivots are provided to the rotor assembly and the moveable contact arms to ensure that the contacts close prior to complete rotation of the rotor assembly. The additional rotation force provided by the rotor assembly then translates into lateral displacement of the moveable contacts relative to the fixed contacts, resulting in contact wiping function. An alternate embodiment utilizes a common pivot for both the rotor assembly and the moveable contact arms, while providing post closure motion by means of a fixed contact compression spring.

10 Claims, 7 Drawing Sheets

U.S. PATENT DOCUMENTS

| | | | | |
|---|---|---|---|---|
| 4,144,513 | A | | 3/1979 | Shafer et al. |
| 4,158,119 | A | | 6/1979 | Krakik |
| 4,165,453 | A | | 8/1979 | Hennemann |
| 4,166,988 | A | | 9/1979 | Ciarcia et al. |
| 4,220,934 | A | | 9/1980 | Wafer et al. |
| 4,255,732 | A | | 3/1981 | Wafer et al. |
| 4,259,651 | A | | 3/1981 | Yamat |
| 4,263,492 | A | | 4/1981 | Maier et al. |
| 4,276,527 | A | | 6/1981 | Gerbert-Gaillard et al. |
| 4,297,663 | A | | 10/1981 | Seymour et al. |
| 4,301,342 | A | | 11/1981 | Castonguay et al. |
| 4,360,852 | A | | 11/1982 | Gilmore |
| 4,368,444 | A | | 1/1983 | Preuss et al. |
| 4,375,021 | A | | 2/1983 | Pardini et al. |
| 4,375,022 | A | | 2/1983 | Daussin et al. |
| 4,376,270 | A | | 3/1983 | Staffen |
| 4,383,146 | A | | 5/1983 | Bur |
| 4,392,036 | A | | 7/1983 | Troebel et al. |
| 4,393,283 | A | | 7/1983 | Masuda |
| 4,401,872 | A | | 8/1983 | Boichot-Castagne et al. |
| 4,409,573 | A | | 10/1983 | DiMarco et al. |
| 4,435,690 | A | | 3/1984 | Link et al. |
| 4,467,297 | A | | 8/1984 | Boichot-Castagne et al. |
| 4,468,645 | A | | 8/1984 | Gerbert-Gaillard et al. |
| 4,470,027 | A | | 9/1984 | Link et al. |
| 4,479,143 | A | | 10/1984 | Watanabe et al. |
| 4,484,164 | A | * | 11/1984 | McClellan et al. ..... 335/195 |
| 4,488,133 | A | * | 12/1984 | McClellan et al. ..... 335/16 |
| 4,492,941 | A | | 1/1985 | Nagel |
| 4,541,032 | A | | 9/1985 | Schwab |
| 4,546,224 | A | | 10/1985 | Mostosi |
| 4,550,360 | A | | 10/1985 | Dougherty |
| 4,562,419 | A | | 12/1985 | Preuss et al. |
| 4,589,052 | A | | 5/1986 | Dougherty |
| 4,595,812 | A | | 6/1986 | Tamaru et al. |
| 4,611,187 | A | | 9/1986 | Banfi |
| 4,612,430 | A | | 9/1986 | Sloan et al. |
| 4,616,198 | A | | 10/1986 | Pardini |
| 4,622,444 | A | | 11/1986 | Kandatsu et al. |
| 4,631,625 | A | | 12/1986 | Alexander et al. |
| 4,642,431 | A | | 2/1987 | Tedesco et al. |
| 4,644,438 | A | | 2/1987 | Puccinelli et al. |
| 4,649,247 | A | | 3/1987 | Preuss et al. |
| 4,658,322 | A | | 4/1987 | Rivera |
| 4,672,501 | A | | 6/1987 | Bilac et al. |
| 4,675,481 | A | | 6/1987 | Markowski et al. |
| 4,682,264 | A | | 7/1987 | Demeyer |
| 4,689,712 | A | | 8/1987 | Demeyer |
| 4,694,373 | A | | 9/1987 | Demeyer |
| 4,710,845 | A | | 12/1987 | Demeyer |
| 4,717,985 | A | | 1/1988 | Demeyer |
| 4,733,211 | A | | 3/1988 | Castonguay et al. |
| 4,733,321 | A | | 3/1988 | Lindeperg |
| 4,756,628 | A | | 7/1988 | Branson |
| 4,764,650 | A | | 8/1988 | Bur et al. |
| 4,768,007 | A | | 8/1988 | Mertz et al. |
| 4,780,786 | A | | 10/1988 | Weynachter et al. |
| 4,831,221 | A | | 5/1989 | Yu et al. |
| 4,870,531 | A | | 9/1989 | Danek |
| 4,883,931 | A | | 11/1989 | Batteux et al. |
| 4,884,047 | A | | 11/1989 | Baginski et al. |
| 4,884,164 | A | | 11/1989 | Dziura et al. |
| 4,900,882 | A | | 2/1990 | Bernard et al. |
| 4,910,485 | A | | 3/1990 | Bolongeat-Mobleu et al. |
| 4,914,541 | A | | 4/1990 | Tripodi et al. |
| 4,916,420 | A | | 4/1990 | Bartolo et al. |
| 4,916,421 | A | | 4/1990 | Pardini et al. |
| 4,926,282 | A | | 5/1990 | McGhie |
| 4,935,590 | A | | 6/1990 | Malkin et al. |
| 4,937,706 | A | | 6/1990 | Schueller et al. |
| 4,939,492 | A | | 7/1990 | Raso et al. |
| 4,943,691 | A | | 7/1990 | Mertz et al. |
| 4,943,888 | A | | 7/1990 | Jacob et al. |
| 4,950,855 | A | | 8/1990 | Bolongeat-Mobleu et al. |
| 4,951,019 | A | | 8/1990 | Gula |
| 4,952,897 | A | | 8/1990 | Barnel et al. |
| 4,958,135 | A | | 9/1990 | Baginski et al. |
| 4,965,543 | A | | 10/1990 | Batteux |
| 4,983,788 | A | | 1/1991 | Pardini |
| 5,001,313 | A | | 3/1991 | Leclerq et al. |
| 5,004,878 | A | | 4/1991 | Seymour et al. |
| 5,029,301 | A | | 7/1991 | Nebon et al. |
| 5,030,804 | A | | 7/1991 | Abri |
| 5,057,655 | A | | 10/1991 | Kersusan et al. |
| 5,077,627 | A | | 12/1991 | Fraisse |
| 5,083,081 | A | | 1/1992 | Barrault et al. |
| 5,095,183 | A | | 3/1992 | Raphard et al. |
| 5,103,198 | A | | 4/1992 | Morel et al. |
| 5,115,371 | A | | 5/1992 | Tripodi |
| 5,120,921 | A | | 6/1992 | DiMarco et al. |
| 5,132,865 | A | | 7/1992 | Mertz et al. |
| 5,138,121 | A | | 8/1992 | Streich et al. |
| 5,140,115 | A | | 8/1992 | Morris |
| 5,153,802 | A | | 10/1992 | Mertz et al. |
| 5,155,315 | A | | 10/1992 | Malkin et al. |
| 5,166,483 | A | | 11/1992 | Kersusan et al. |
| 5,172,087 | A | | 12/1992 | Castonguay et al. |
| 5,178,504 | A | | 1/1993 | Falchi |
| 5,184,717 | A | | 2/1993 | Chou et al. |
| 5,187,339 | A | | 2/1993 | Lissandrin |
| 5,198,956 | A | | 3/1993 | Dvorak |
| 5,200,724 | A | | 4/1993 | Gula et al. |
| 5,210,385 | A | | 5/1993 | Morel et al. |
| 5,239,150 | A | | 8/1993 | Bolongeat-Mobleu et al. |
| 5,260,533 | A | | 11/1993 | Livesey et al. |
| 5,262,744 | A | | 11/1993 | Arnold et al. |
| 5,280,144 | A | | 1/1994 | Bolongeat-Mobleu et al. |
| 5,281,776 | A | | 1/1994 | Morel et al. |
| 5,296,660 | A | | 3/1994 | Morel et al. |
| 5,296,664 | A | | 3/1994 | Crookston et al. |
| 5,298,874 | A | | 3/1994 | Morel et al. |
| 5,300,907 | A | | 4/1994 | Nereau et al. |
| 5,310,971 | A | | 5/1994 | Vial et al. |
| 5,313,180 | A | | 5/1994 | Vial et al. |
| 5,317,471 | A | | 5/1994 | Izoard et al. |
| 5,331,500 | A | | 7/1994 | Corcoles et al. |
| 5,334,808 | A | | 8/1994 | Bur et al. |
| 5,341,191 | A | | 8/1994 | Crookston et al. |
| 5,347,096 | A | | 9/1994 | Bolongeat-Mobleu et al. |
| 5,347,097 | A | | 9/1994 | Bolongeat-Mobleu et al. |
| 5,350,892 | A | | 9/1994 | Rozier |
| 5,351,024 | A | * | 9/1994 | Juds et al. ..... 335/16 |
| 5,357,066 | A | | 10/1994 | Morel et al. |
| 5,357,068 | A | | 10/1994 | Rozier |
| 5,357,394 | A | | 10/1994 | Piney |
| 5,361,052 | A | | 11/1994 | Ferullo et al. |
| 5,361,951 | A | | 11/1994 | Chehebar |
| 5,373,130 | A | | 12/1994 | Barrault et al. |
| 5,379,013 | A | | 1/1995 | Coudert |
| 5,424,701 | A | | 6/1995 | Castonguary et al. |
| 5,438,176 | A | | 8/1995 | Bonnardel et al. |
| 5,440,088 | A | | 8/1995 | Coudert et al. |
| 5,449,871 | A | | 9/1995 | Batteux et al. |
| 5,450,048 | A | | 9/1995 | Leger et al. |
| 5,451,729 | A | | 9/1995 | Onderka et al. |
| 5,457,295 | A | | 10/1995 | Tanibe et al. |
| 5,467,069 | A | | 11/1995 | Payet-Burin et al. |
| 5,469,121 | A | | 11/1995 | Payet-Burin |
| 5,475,558 | A | | 12/1995 | Barjonnet et al. |
| 5,477,016 | A | | 12/1995 | Baginski et al. |
| 5,479,143 | A | | 12/1995 | Payet-Burin |

| | | | | |
|---|---|---|---|---|
| 5,483,212 | A | | 1/1996 | Lankuttis et al. |
| 5,485,343 | A | | 1/1996 | Santos et al. |
| D367,265 | S | | 2/1996 | Yamagata et al. |
| 5,493,083 | A | | 2/1996 | Olivier |
| 5,502,428 | A | * | 3/1996 | McColloch et al. ..... 335/172 |
| 5,504,284 | A | | 4/1996 | Lazareth et al. |
| 5,504,290 | A | | 4/1996 | Baginski et al. |
| 5,510,761 | A | | 4/1996 | Boder et al. |
| 5,512,720 | A | | 4/1996 | Coudert et al. |
| 5,515,018 | A | | 5/1996 | DiMarco et al. |
| 5,519,561 | A | | 5/1996 | Mrenna et al. |
| 5,534,674 | A | | 7/1996 | Steffens |
| 5,534,832 | A | | 7/1996 | Duchemin et al. |
| 5,534,835 | A | | 7/1996 | McColloch et al. |
| 5,534,840 | A | | 7/1996 | Cuingnet |
| 5,539,168 | A | | 7/1996 | Linzenich |
| 5,543,595 | A | | 8/1996 | Mader et al. |
| 5,552,755 | A | | 9/1996 | Fello et al. |
| 5,581,219 | A | | 12/1996 | Nozawa et al. |
| 5,604,656 | A | | 2/1997 | Derrick et al. |
| 5,608,367 | A | | 3/1997 | Zoller et al. |
| 5,784,233 | A | | 7/1998 | Bastard et al. |

FOREIGN PATENT DOCUMENTS

| | | | |
|---|---|---|---|
| DE | 38 02 184 | | 8/1989 |
| DE | 38 43 277 | | 6/1990 |
| DE | 44 19 240 | | 1/1995 |
| EP | 0 061 092 | | 9/1982 |
| EP | 0 064 906 | | 11/1982 |
| EP | 0 066 486 | | 12/1982 |
| EP | 0 076 719 | | 4/1983 |
| EP | 0 117 094 | | 8/1984 |
| EP | 0 140 761 | | 5/1985 |
| EP | 0 174 904 | | 3/1986 |
| EP | 0 196 241 | | 10/1986 |
| EP | 0 224 396 | | 6/1987 |
| EP | 0 235 479 | | 9/1987 |
| EP | 0 239 460 | | 9/1987 |
| EP | 0 258 090 | | 3/1988 |
| EP | 0 264 313 | | 4/1988 |
| EP | 0 264 314 | | 4/1988 |
| EP | 0 283 189 | | 9/1988 |
| EP | 0 283 358 | | 9/1988 |
| EP | 0 291 374 | | 11/1988 |
| EP | 0 295 155 | | 12/1988 |
| EP | 0 295 158 | | 12/1988 |
| EP | 0 309 923 | | 4/1989 |
| EP | 0 313 106 | | 4/1989 |
| EP | 0 313 422 | | 4/1989 |
| EP | 0 314 540 | | 5/1989 |
| EP | 0 331 586 | | 9/1989 |
| EP | 0 337 900 | | 10/1989 |
| EP | 0 342 133 | | 11/1989 |
| EP | 0 367 690 | | 5/1990 |
| EP | 0 371 887 | | 6/1990 |
| EP | 0 375 568 | | 6/1990 |
| EP | 0 394 144 | | 10/1990 |
| EP | 0 394 922 | | 10/1990 |
| EP | 0 399 282 | | 11/1990 |
| EP | 0 407 310 | | 1/1991 |
| EP | 0 452 230 | | 10/1991 |
| EP | 0 555 158 | | 8/1993 |
| EP | 0 560 697 | | 9/1993 |
| EP | 0 567 416 | | 10/1993 |
| EP | 0 595 730 | | 5/1994 |
| EP | 0 619 591 | | 10/1994 |
| EP | 0 665 569 | | 8/1995 |
| EP | 0 667 630 | A | 8/1995 |
| EP | 0 700 140 | | 3/1996 |
| EP | 0 889 498 | | 1/1999 |
| FR | 2 410 353 | | 6/1979 |
| FR | 2 512 582 | | 3/1983 |
| FR | 2 553 943 | | 4/1985 |
| FR | 2 592 998 | | 7/1987 |
| FR | 2 682 531 | | 4/1993 |
| FR | 2 697 670 | | 5/1994 |
| FR | 2 699 324 | | 6/1994 |
| FR | 2 714 771 | | 7/1995 |
| GB | 2 233 155 | | 1/1991 |
| SU | 1 227 678 | | 4/1986 |
| WO | 92/00598 | | 1/1992 |
| WO | 92/05649 | | 4/1992 |
| WO | 94/00901 | | 1/1994 |

* cited by examiner

ROTARY CONTACT ASSEMBLY FOR HIGH AMPERE-RATED CIRCUIT BREAKERS

BACKGROUND OF THE INVENTION

This invention relates to circuit breakers, and, more particularly, to a rotary contact assembly for high ampere-rated circuit breakers.

U.S. Pat. No. 4,616,198 entitled Contact Arrangement For A Current Limiting Circuit Breaker, describes the early use of a first and second pair of circuit breaker contacts arranged in series to substantially reduce the amount of current let-through upon the occurrence of an overcurrent condition. A more recent description is found within U.S. Pat. No. 6,114,641 entitled Rotary Contact Assembly For High Ampere-Rated Circuit Breakers.

When the contact pairs are arranged upon one movable contact arm such as described within U.S. Pat. No. 4,910,485 entitled Multiple Circuit Breaker With Double Break Rotary Contact, some means must be provided to insure that the opposing contact pairs provide a wiping action upon closure to remove any oxides or other contaminants developed upon the contact surfaces.

One arrangement for providing such wiping motion within circuit breakers containing pivotally-arranged contacts is within U.S. Pat. No. 5,361,051 entitled Pivoting Circuit Breaker Arm Assembly. This arrangement includes an elongate slot formed within the moveable contact arm to provide wiping action upon contact closure. Early teachings of the use of a slotted moveable contact arm for wiping the circuit breaker contacts is found within U.S. Pat. No. 4,756,628 entitled Circuit Breaker, as well as U.S. Pat. No. 4,484,164 entitled Braidless Movable Contact With Wiping Action.

In so-called "vacuum" circuit interrupters, wherein continuous wiping of the contact surfaces is imperative to long term operation, the wiping motion is achieved by the addition of a wiping spring in addition to the contact closing springs for continued motion of the contacts in the parallel plane after the closing springs have initially become engaged. One example of a wiping spring used within vacuum circuit breakers is found in Canadian Patent No. CA 1,098,570 entitled Contact Controller For Vacuum-Type Circuit Interrupter.

It would be economically advantageous to provide rotary contacts with wiping action upon contact closure without having to employ elongated pivot openings within the contact arms and without having to employ an auxiliary wiping spring.

SUMMARY OF THE INVENTION

In an exemplary embodiment of the invention, automatic contact wiping between circuit breaker rotary contacts upon contact closure is provided for removing contaminants and oxides from the contact surfaces, at a minimum increase in manufacturing costs. The circuit breaker rotary contact assembly employs a common pivot between the rotor assembly and the rotary contact arm. A pair of off-center expansion springs directly engage the rotor at one end and engage the rotary contact arm via a linkage arrangement at an opposite end thereof. Separate pivots are provided to the rotor assembly and the moveable contact arms ensure that the contacts close prior to complete rotation of the rotor assembly. The additional rotation force provided by the rotor assembly then translates into lateral displacement of the moveable contacts relative to the fixed contacts, resulting in contact wiping function.

An alternate embodiment utilizes a common pivot point between the rotor assembly and the moveable contact arms, while providing slight post closure motion by means of a fixed contact support spring.

DESCRIPTION OF THE PREFERRED EMBODIMENT

Figure 1:
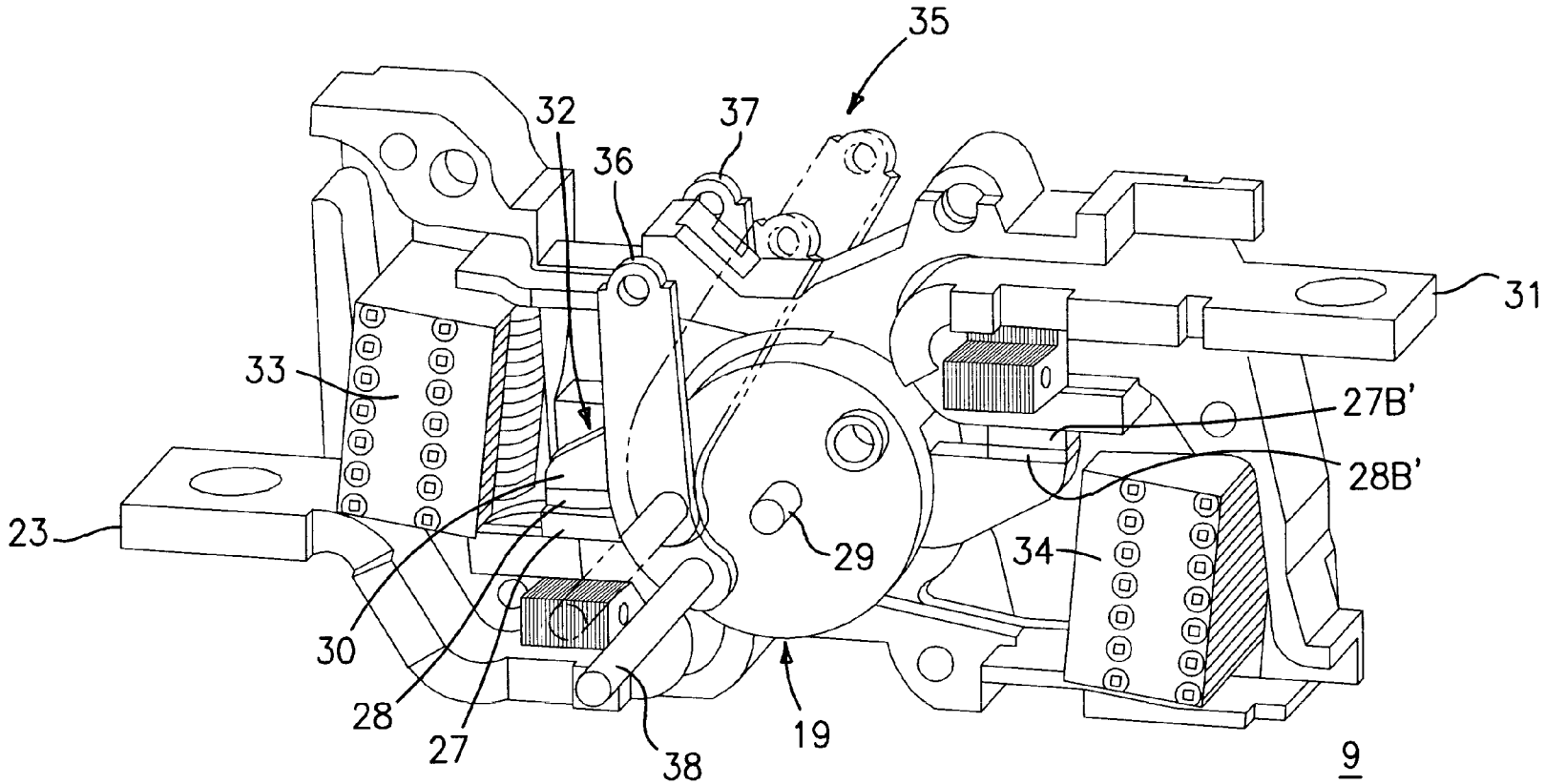
FIG. 1 is a front perspective view of a circuit breaker rotary contact assembly according to a first embodiment of the invention.

The circuit breaker rotary contact assembly 10 shown in FIG. 1 is similar to that described within the aforementioned U.S. Pat. No. 4,649,247 and the aforetneioned U.S. Pat. No. 6,114,641 entitled Rotary Contact Assembly For High Ampere-Rated Circuit Breakers, both of which are incorporated herein by reference. Opposing line and load straps 11, 12 are adapted for connection with an associated electrical distribution system and a protected electric circuit, respectively. Fixed contacts 24, 26 connect with the line and the load straps while the moveable contacts 23, 25 are attached to the ends of moveable contact arms 21, 22 for making moveable connection with the associated fixed contacts to complete the circuit connection with the line and load straps 11, 12. As described within the aforementioned U.S. Pat. No. 6,114,641 entitled Rotary Contact Assembly For High Ampere-Rated Circuit Breakers, the movable contact arms 21, 22 are of unitary structure and rotate within the rotor and contact arm assembly 15 about the contact arm pivot 27 when rotated upon response to the circuit breaker operating mechanism (not shown) by connection via the pins 18 and the pair of opposing levers 16, 17. The arcs generated when the contacts 23, 24 and 25, 26 are separated upon overload circuit current conditions are cooled and quenched within the arc chambers 13, 14 to interrupt current through the protected circuit. In accordance with the invention, the rotor 19 rotates about a rotor pivot 20 in response to the circuit breaker operating mechanism and interacts with the moveable contact arms 21, 22 in the manner best seen by now referring to FIG. 2.

Figure 2:
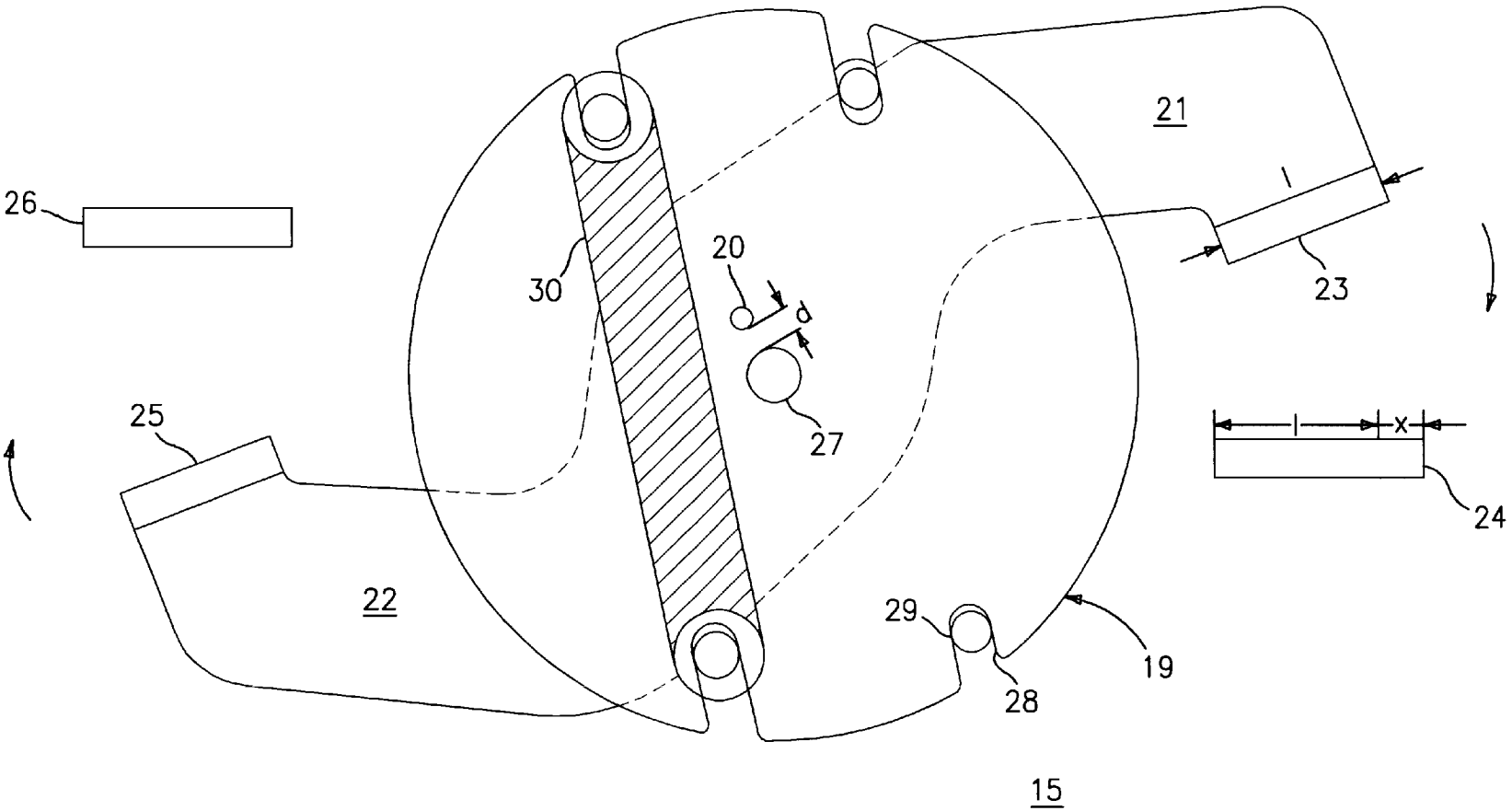
FIG. 2 is an enlarged side view of a part of the rotor and contact arm assembly within the rotary contact assembly of FIG. 1 with the contacts depicted in the OPEN position.

The contact assembly 15 in the circuit breaker rotary contact assembly 10 of FIG. 1 is shown in FIG. 2 as a rotor 19 in the form of a pair of opposing rotors, with only one of which depicted for purpose of clarity. The opposing rotors 19 are connected with the moveable contact arms 21, 22 by means of pins 29 extending within slots 28 formed within opposing sides of the rotors. Compression springs 30 extend between the pins 28 to allow simultaneous rotation of the rotors and the movable contact arms about the rotor pivot 20 and the contact arm pivot 27. In accordance with the invention, the rotor pivot 20 is off-set from the contact arm pivot 27 by a predetermined distance "d" and the fixed contacts 24 are longer than the moveable contacts 23 by a predetermined distance "x" to provide automatic contact wiping between the movable contacts 23, 25 and fixed contacts 24, 26.

Figure 3:
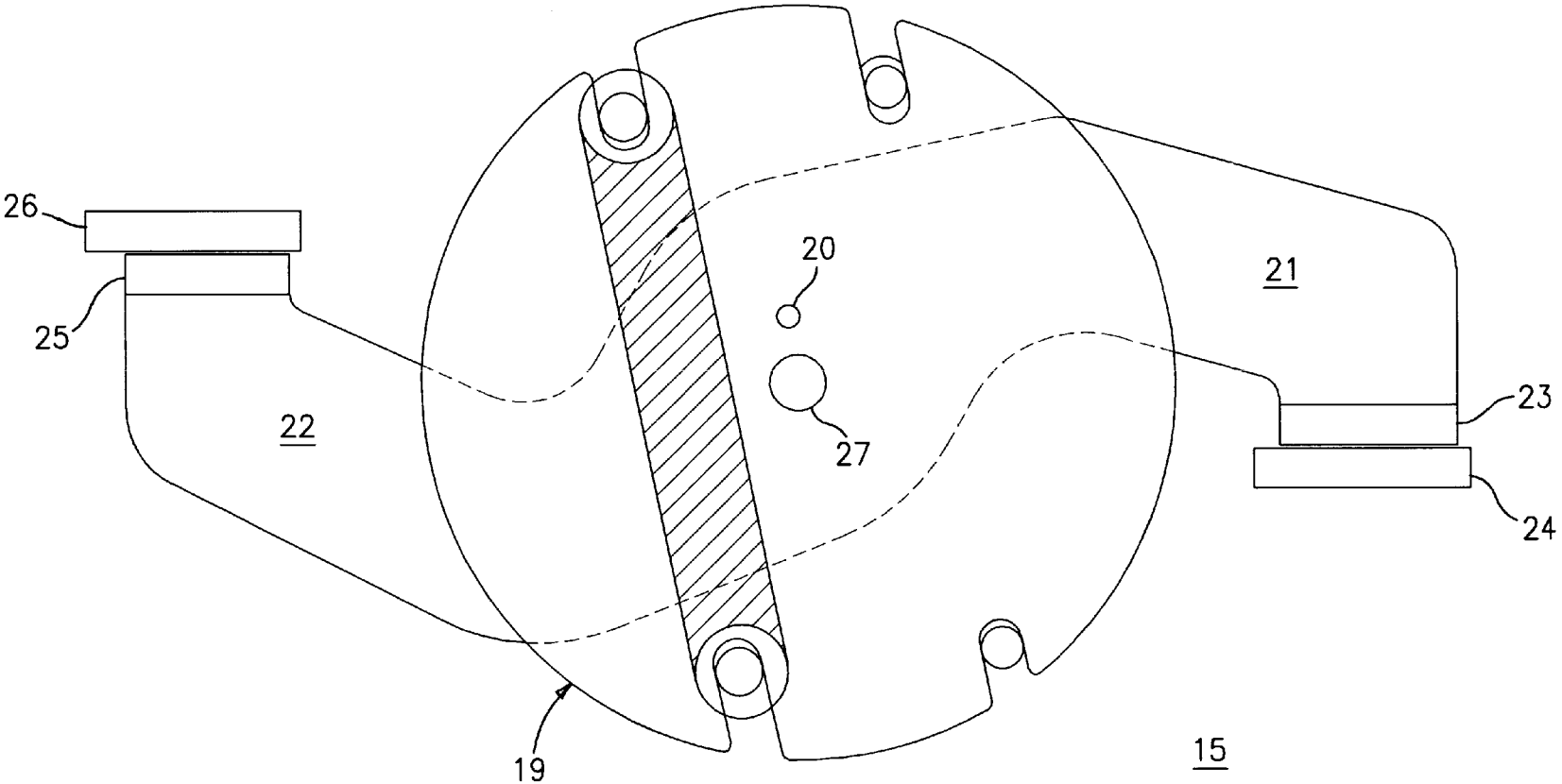
FIG. 3 is a an enlarged side view of the rotor and contact arm assembly of FIG. 1 with the contacts in the final CLOSED position.

When the contact assembly 15 is rotated in the indicated clockwise direction upon contact closure as shown in FIG. 3, the movable contact arms 21, 22 rotate about the contact arm pivot 27 to drive the movable contacts 23, 25 into initial contact with the fixed contacts 24, 26 before the rotors 19 have completed rotation about the rotor pivot 20.

Figure 4:
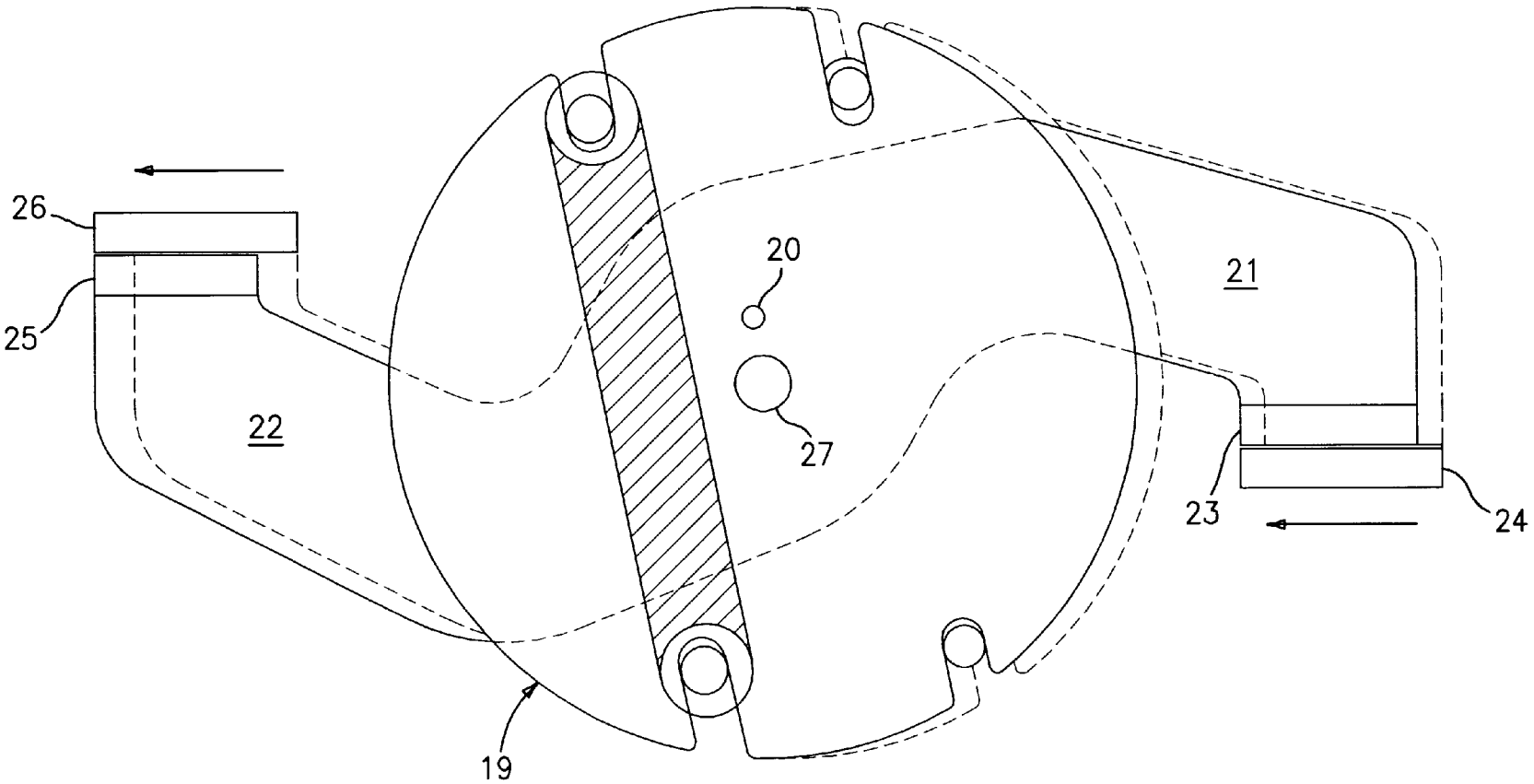
FIG. 4 is an enlarged side view of the rotor and contact arm of FIG. 1 with the contacts in the final CLOSED position.
Figure 5:
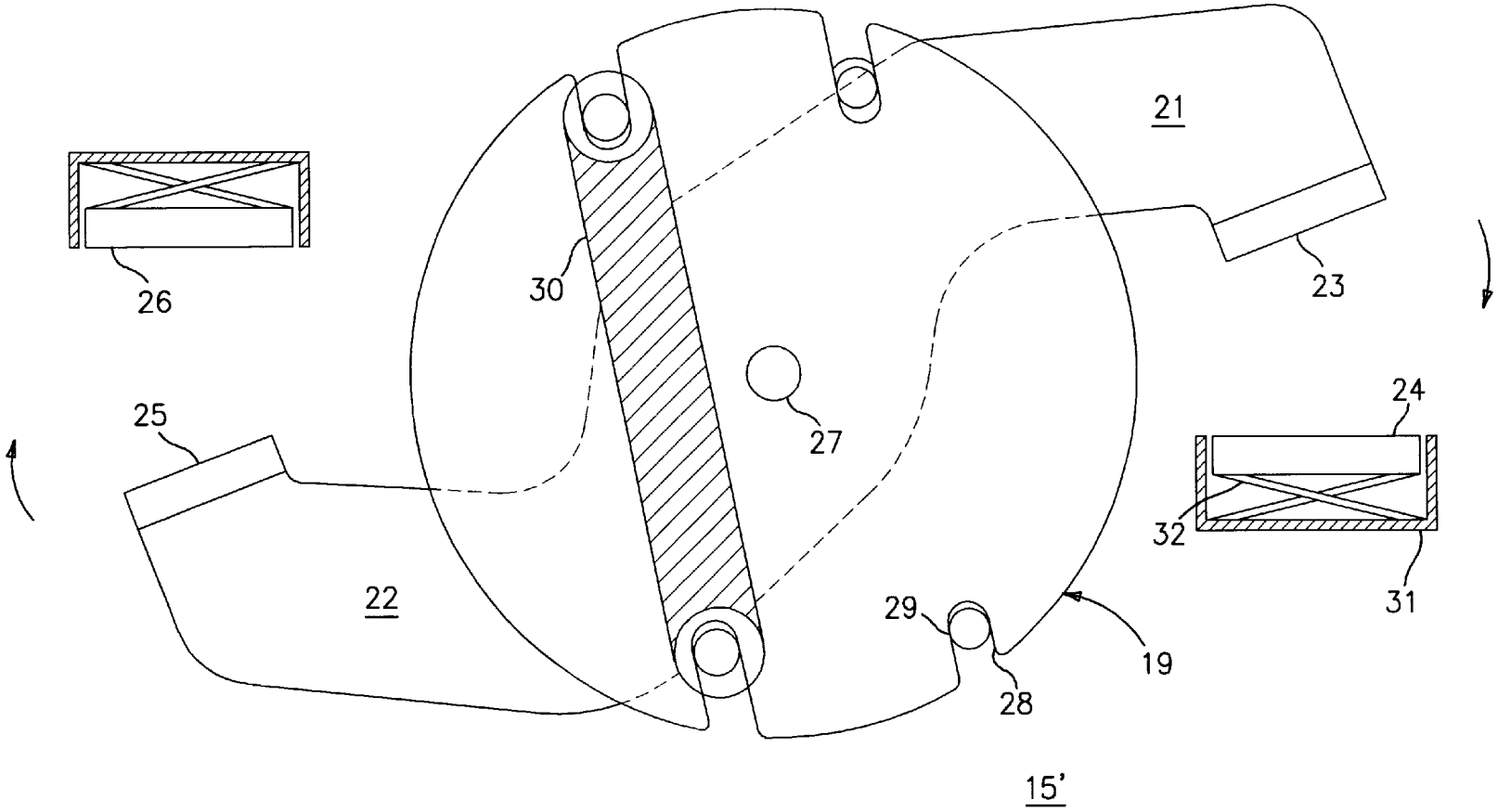
FIG. 5 is an enlarged side view of an alternate embodiment of the rotor and contact arm assembly within the rotary contact assembly of FIG. 1 with the contacts in the OPEN condition.
Figure 6:
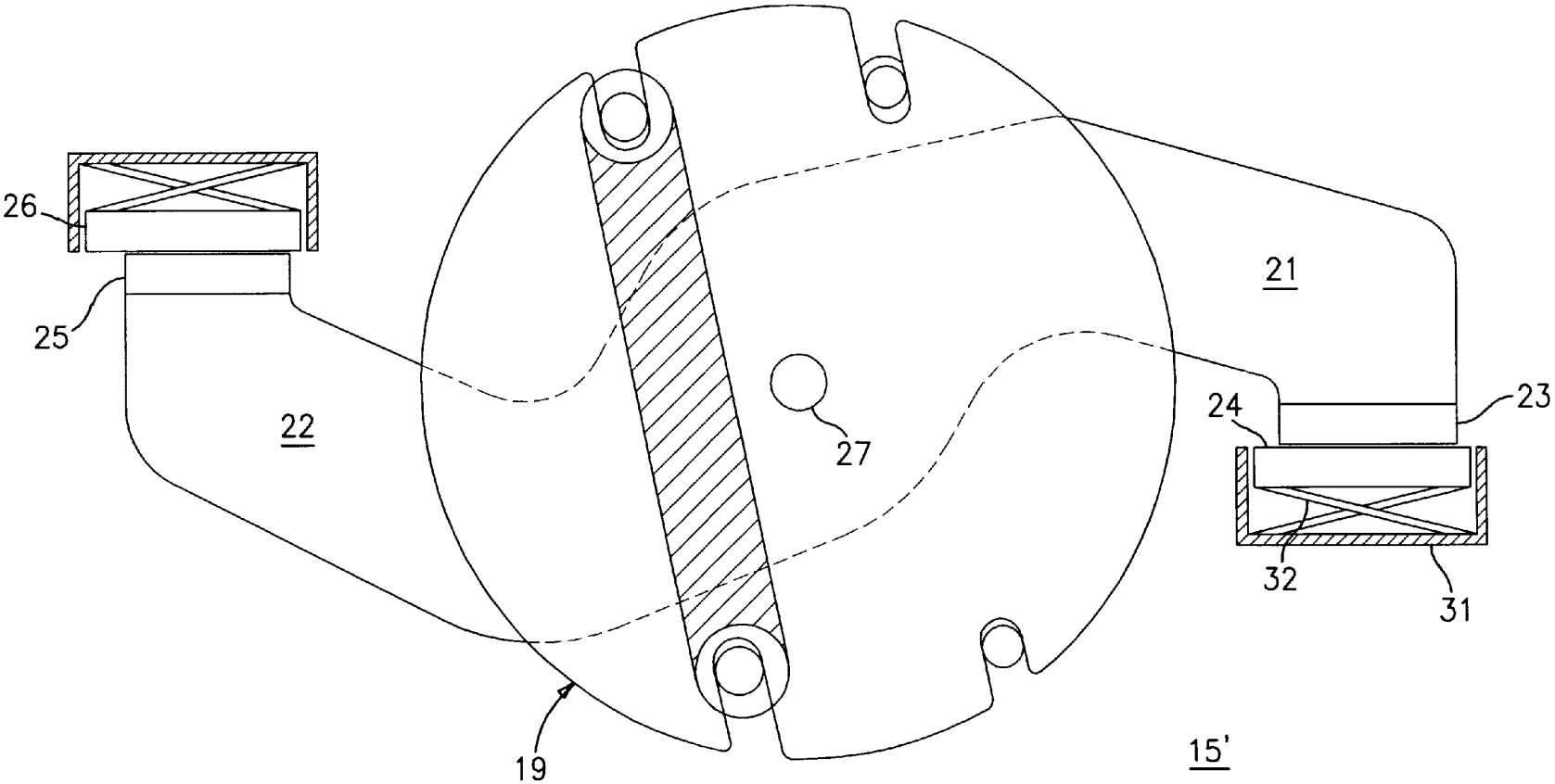
FIG. 6 is an enlarged side view of the embodiment of FIG. 5 with the contacts in the initial CLOSED position.
Figure 7:
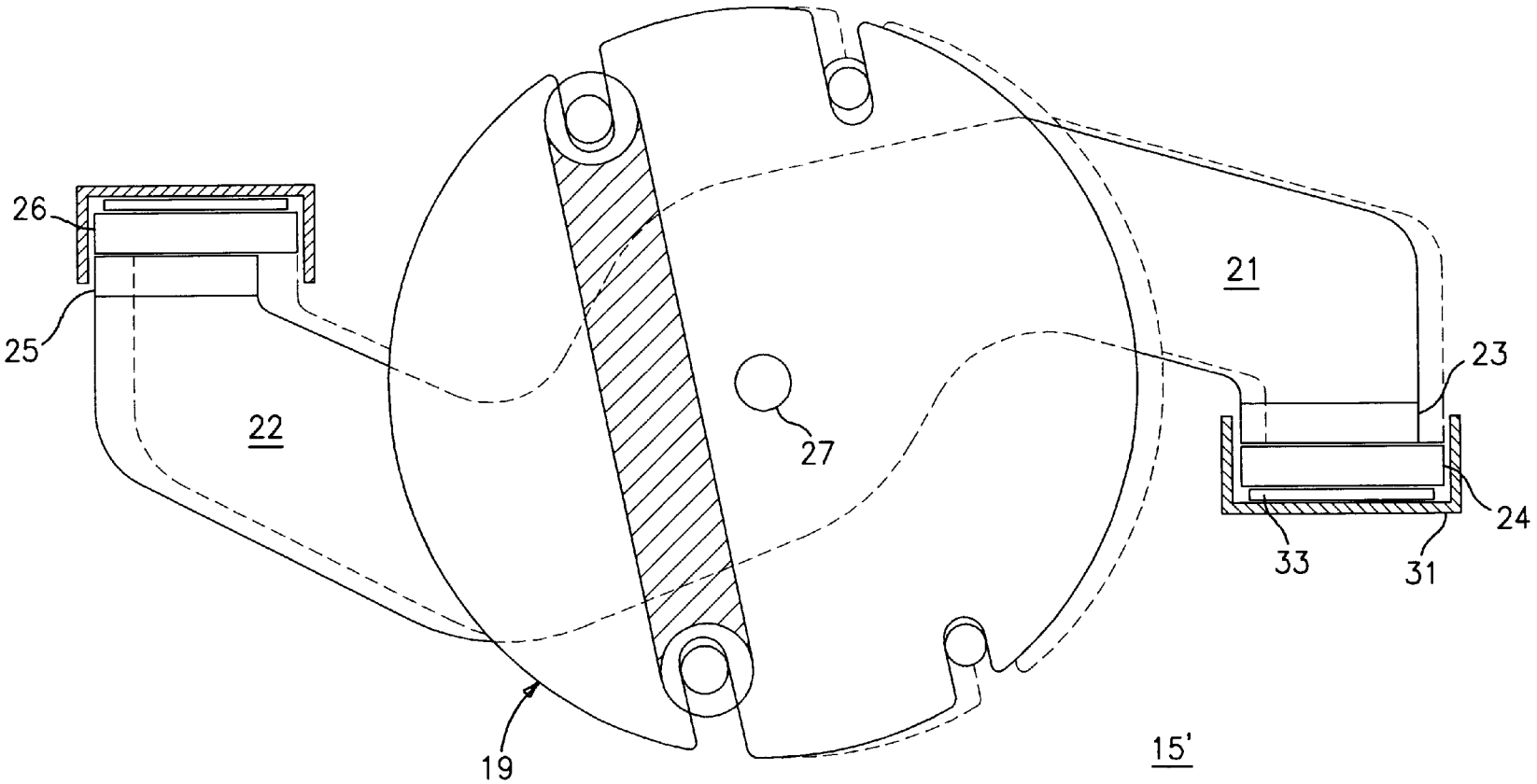
FIG. 7 is an enlarged side view of the embodiment of FIG. 5 with the contacts in the final CLOSED position.

As shown in FIG. 4, the rotor 19 continues to rotate about rotor pivot 20 from the initial position indicated in phantom to the final position indicated in solid lines. The continued rotation of the rotor forces the moveable contact arms 21, 22 and moveable contacts 23, 25 to move about the contact arm pivot 27 from the initial position indicated in phantom to the final position indicated in solid lines, causing the moveable contacts to move in the indicated direction across the fixed contacts to provide the contact wiping action. An alternate arrangement for providing contact wiping using the rotary contact assembly 15 described within the aforementioned U.S. patent application entitled Rotary Contact Assembly For High Ampere-Related Circuit Breakers, is now shown in FIGS. 5 and 7. The rotor 19 rotates in common with the moveable contact arm pivot 27 and the rotor is attached to the moveable contact arm pivot by the arrangement of pins 29 within slots 28 and by means of expansion springs 30, in the manner described earlier. The moveable contacts 23, 25 are smaller than the fixed contacts 24, 26 to the same extent as described earlier herein. The fixed contacts are arranged within a fixed contact receptacle 31, that includes a compression spring 32. When the rotor 19 is rotated in the clockwise indicated direction from the contact OPEN position depicted in FIG. 5, to the contact initial CLOSED position indicated in FIG. 6, the moveable contacts 23, 25 strike the fixed contacts 24, 26 causing the compression spring 32 to become compressed to the position indicated within the final CLOSED position depicted in FIG. 7. The depression of the fixed contacts 24, 26 within the contact retainers 31 forces the moveable contacts 23, 25 to move along the surface of the depressed fixed contacts 24, 26 in the manner indicated in phantom to provide the automatic contact wiping function.

Two separate arrangements have herein been depicted for providing contact wiping function between the fixed and moveable contacts within circuit breakers employing rotary contact assemblies. The provision of larger fixed contacts allows such contact wiping to occur when extra force function is provided to the moveable contacts beyond the contact closing function.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. The electrical contactor comprising:

a moveable support within a housing positionable in an open position and a closed position, said movable support comprises a pivotably supported rotor that rotates on a first axis with respect to said housing, said rotor rotates in a first direction about said first axis when moving from said open position to said closed position;

a contract arm rotatably supported by said moveable support, said contact arm and said moveable support pivot with respect to each other about a second axis, said first axis and said second axis not being coincident;

a first contact on said contact arm;

a second contact supported in said housing, wherein when said movable support is in a said open position, said first and second contacts are not in contact with each other, and when said movable support is in said closed position, said first and second contacts are in contact with each other; and wherein as said movable support rotates to said closed position, said movable support first causes said second and first contacts to touch, then causes said first contact and said second contact to slide against each other.

2. The electrical contactor set forth in claim 1 wherein as said movable support rotates to said closed position, said contact arm does not pivot on said second axis until said first and second contacts meet, at which point said movable support continues to rotate to its final closed position and said contact arm rotates on said second axis, the lack of coincidence of said first axis and said second axis causing said first and second contacts to slide against each other.

3. The electrical contactor set forth in claim 1 wherein said first axis and said second axis are parallel to each other.

a contact arm connected to said movable support at a fixed pivot point so that said contact arm is rotatably supported by and is connected to said movable support;

a first contact on said contact arm;

a second contact supported in said housing; wherein when said movable support is in said open position, said first and second contacts are not in contact with each other, and when said movable arm is in said closed position, said first and second contacts are in contact with each other; and an operating mechanism connected to said movable support causing said movable support to move between said open and closed positions, wherein as said movable support moves to said closed position, it first causes said second and first contacts to touch, then causes said first contact and said second contact to slide against each other.

4. The electrical contactor set forth in claim 1 further comprising third and fourth contacts; said third contact disposed on an opposite end of said contact arm from said first contact and said fourth contact supported in said housing wherein said third and fourth contacts are not in contact with each other when said movable support is in said open position and said third and fourth contacts are in contact with each other when said movable support is in said closed position.

5. An electrical contractor comprising:

a contact arm rotatably supported within a housing;

a first contact on said contact arm;

a second contact supported in said housing, wherein when said contact arm is in an open position, said first and second contacts are not in contact with each other, and when said contact arm is in a closed position, said first and second contacts are in contact with each other;

a first spring arranged to bias said second contact, said second contact being constrained to move along a first path that is not parallel or coincident with a path of movement of said first contact;

wherein as said contact arm moves to said closed position, said first contact first contacts said second contact, then pushes said second contact against a force of said first spring causing said first contact and said second contact to slide against each other until said contact arm finally reaches said closed position; and a third contact and a fourth contact, said third contact disposed on an opposite end of said contact arm from said first contact and said fourth contact connected to said housing by a second spring and constrained to move along a second path that is not parallel or coincident with a path of movement of said third contact.

6. A circuit breaker comprising:

a moveable support within a housing positionable in an open position and a closed position, said movable support comprises a pivotably supported rotor that rotates on a first axis with respect to said housing, said rotor rotates in a first direction about said first axis when moving from said open position to said closed position;

a contact arm connected to said movable support at a fixed pivot point so that said contact arm is rotatably supported by and is connected to said movable support, said contact arm and said movable support pivot with respect to each other about a second axis, said first axis and said second axis not being coincident;

a first contact on said contact arm;

a second contact supported in said housing, wherein when said movable support is in said open position, said first and second contacts are not in contact with each other, and when said movable arm is in said closed position, said first and second contacts are in contact with each other; and an operating mechanism connected to said movable support causing said movable support to move between said open and closed positions, wherein as said movable support moves to said closed position, it first causes said second and first contacts to touch, then causes said first contact and said second contact to slide against each other.

7. The circuit breaker set forth in claim 6 wherein as said movable support rotates to said closed position, said contact arm does not pivot on said second axis with respect to said movable support until said first and second contacts meet, at which point said movable support continues to rotate to its final closed position and said contact arm rotates on said second axis, the lack of coincidence of said first axis and said second axis causing said first and second contacts to slide against each other.

8. The circuit breaker set forth in claim 6 wherein said first axis and said second axis are substantially parallel to each other.

9. The circuit breaker set forth in claim 6 further comprising third and fourth contacts; said third contact disposed on an opposite end of said contact arm from said first contact, and said fourth contact supported in said housing wherein said third and fourth contacts are not in contact with each other when said movable support is in said open position and said third and fourth contacts are in contact with each other when said movable support is in said closed position.

10. A circuit breaker comprising:

a movable support within a housing positionable in an open position and a closed position;

a contact arm connected to said movable support at a fixed pivot point so that said contact arm is rotatably supported by and is connected to said movable support;

a first contact on said contact arm;

a second contact supported in said housing, wherein when said movable support is in said open position, said first and second contacts are not in contact with each other, and when said movable support is in said closed position, said first and second contacts are in contact with each other;

a first spring arranged to bias said second contact, said second contact being constrained to move along a first path that is not parallel or coincident with a path of movement of said first contact;

an operating mechanism connected to said movable support causing said movable support to move between said open and closed positions, wherein as said movable support moves to said closed position, said first contact first contacts said second contact, then pushes said second contact against a force of said spring causing said first contact and said second contact to slide against each other until said movable support finally reaches said closed position; and a third contact and a fourth contact, said third contact disposed on an opposite end of said contact arm from said first contact and said fourth contact connected to said housing by a second spring and constrained to move along a second path that is not parallel or coincident with a path of movement of said third contact.

* * * * *

UNITED STATES PATENT AND TRADEMARK OFFICE

CERTIFICATE OF CORRECTION

PATENT NO. : 6,396,369 B1
DATED : May 28, 2002
INVENTOR(S) : Dan Schlitz

It is certified that error appears in the above-identified patent and that said Letters Patent is hereby corrected as shown below:

Title page,
Item [56], References Cited, FOREIGN PATENT DOCUMENTS, delete "1 227 678" and insert therefor -- 1 227 978 --.

Column 1,
Line 57, after "a" delete "common pivot between the rotor assembly and the rotary contact arm. A".

Column 4,
Line 2, before "electrical" delete "The" and insert therefor -- An --.
Line 10, before "arm" delete "contract" and insert therefor -- contact --.
Line 16, after "support is in" delete "a" .
Line 33, delete claim 3 and insert therefor
-- The electrical contactor set forth in claim 1, wherein:
said first axis and said second axis are parallel to each other; said contact arm is connected to said movable support at a fixed pivot point so that said contact are is rotatably supported by and is connected to said movable support; and further comprising an operating mechanism connected to said movable support causing said movable support to move between said open and closed positions, wherein as said movable support moves to said closed position, it first causes said second and first contacts to touch, then causes said first contact and said second contact to slide against each other. --.
Line 63, after "electrical" delete "contractor" and insert therefor -- contactor --.

Signed and Sealed this

Eighteenth Day of October , 2005

JON W. DUDAS
*Director of the United States Patent and Trademark Office*